US005320276A

United States Patent [19]

Van Malderghem et al.

[11] Patent Number: 5,320,276

[45] Date of Patent: Jun. 14, 1994

[54] CUT SHEET MAILER BUSINESS FORM ASSEMBLY

[75] Inventors: Edmund G. Van Malderghem, Lewiston; Dominick L. Monico, Amherst; Robert P. Coe, Williamsville, all of N.Y.

[73] Assignee: Moore Business Forms, Inc., Grand Island, N.Y.

[21] Appl. No.: 928,765

[22] Filed: Aug. 17, 1992

Related U.S. Application Data

[63] Continuation of Ser. No. 462,842, Dec. 26, 1989, which is a continuation of Ser. No. 303,985, Jan. 27, 1989, which is a continuation-in-part of Ser. No. 97,318, Sep. 11, 1987, which is a continuation of Ser. No. 900,230, Aug. 25, 1986, which is a continuation of Ser. No. 542,350, Oct. 17, 1983.

[51] Int. Cl.[5] ..... D65D 27/00

[52] U.S. Cl. ..... 229/92.1; 229/80

[58] Field of Search ..... 229/92, 92.1, 92.3, 229/68 R, 72, 80, 304, 69

[56] References Cited

U.S. PATENT DOCUMENTS

| | | | |
|---|---|---|---|
| 123,389 | 2/1872 | Foster | 229/92.1 |
| 211,725 | 1/1879 | Foster | 206/610 X |
| 1,159,736 | 11/1915 | Berold | 229/80 |
| 2,148,886 | 2/1939 | Wanser | 229/69 |
| 2,580,886 | 1/1952 | Broudy | 229/72 |
| 3,092,401 | 6/1963 | Steidinger . | |
| 3,104,799 | 9/1963 | Steidinger . | |
| 3,197,121 | 7/1965 | Hayes, Jr. | 229/92.1 |
| 3,339,826 | 9/1967 | Beskind . | |
| 3,339,827 | 9/1967 | Steidinger . | |
| 3,411,699 | 11/1968 | Pine et al. | 229/69 |
| 3,437,259 | 4/1969 | Steidinger . | |
| 3,476,307 | 11/1969 | Faltin et al. . | |
| 3,482,780 | 12/1969 | Johnsen | 229/69 |
| 3,507,444 | 4/1970 | Werby | 229/80 |
| 3,523,638 | 8/1970 | Moonan | 229/92.1 |
| 3,552,641 | 1/1971 | Bell et al. . | |
| 3,756,889 | 9/1973 | Wolfberg et al. . | |
| 3,790,070 | 2/1974 | Schnitzer et al. . | |

(List continued on next page.)

FOREIGN PATENT DOCUMENTS

| | | |
|---|---|---|
| 27554 | 11/1980 | Australia . |
| 2163376 | 6/1973 | Fed. Rep. of Germany . |
| 2645512 | 10/1976 | Fed. Rep. of Germany . |

(List continued on next page.)

*Primary Examiner*—Bryon P. Gehman
*Attorney, Agent, or Firm*—Nixon & Vanderhye

[57] ABSTRACT

A cut sheet mailer business form assembly comprises a non-adhesive bearing message sheet and one or more adhesive-bearing cover sheets prepared for printing of the message sheet, alignment and sealing to provide multiple mailers.

A rectangular message sheet has end edges, marginal edges, a longitudinal dimension between the end edges along a longitudinal axis, and a transverse dimension between the marginal edges along a transverse axis. Marginal lines of perforations are along the marginal edges of the message sheet extending fully between the end edges. Transverse end lines of perforations extend along the end edges between the marginal lines of perforations. A rectangular cover sheet has cover sheet end edges, cover sheet marginal edges, a longitudinal dimension between the cover sheet end edges equal to the longitudinal dimension of the message sheet, and a transverse dimension between the cover sheet marginal edges equal to the transverse dimension of the message sheet. The cover sheet is superimposed upon the message sheet. Marginal lines of adhesive are along the cover sheet marginal edges extending fully between the cover sheet end edges and being nearer the cover sheet marginal edges than the message sheet marginal perforation lines are to the message sheet marginal edges. Transverse end lines of adhesive are along the cover sheet end edges extending fully between the cover sheet marginal edges and being nearer the cover sheet end edges than the message sheet end perforation lines are to the message sheet end edges. The marginal and end lines of adhesive adhere the cover sheet to the message sheet.

8 Claims, 4 Drawing Sheets

U.S. PATENT DOCUMENTS

| | | | |
|---|---|---|---|
| 3,837,565 | 9/1974 | Johnsen | 229/68 R |
| 3,941,308 | 3/1976 | DiGirolomo et al. . | |
| 3,995,808 | 12/1976 | Kehoe | 229/92.1 X |
| 4,050,582 | 9/1977 | Kalve | 229/69 X |
| 4,055,294 | 10/1977 | Traise | 229/304 X |
| 4,277,016 | 7/1981 | Wakeman et al. | 229/80 X |
| 4,320,868 | 3/1982 | Peterson . | |
| 4,342,418 | 8/1982 | Meschi | 229/92.1 |
| 4,342,472 | 8/1982 | Heimann et al. . | |
| 4,343,492 | 8/1982 | Fitzgibbons . | |
| 4,346,916 | 8/1982 | Shelton | 229/69 X |
| 4,380,315 | 4/1983 | Steidinger . | |

FOREIGN PATENT DOCUMENTS

| | | | |
|---|---|---|---|
| 2655904 | 6/1977 | Fed. Rep. of Germany . | |
| 00226 | 7/1980 | Fed. Rep. of Germany . | |
| 2900226 | 7/1980 | Fed. Rep. of Germany . | |
| 2281284 | 3/1976 | France . | |
| 2387164 | 11/1978 | France . | |
| 2431964 | 2/1980 | France . | |
| 50-155375 | 12/1975 | Japan . | |
| 19450 | 6/1976 | Japan . | |
| 6708451 | 12/1968 | Netherlands . | |
| 7750 | of 1897 | United Kingdom | 229/92.1 |
| 809953 | 3/1959 | United Kingdom . | |
| 1594798 | 8/1981 | United Kingdom . | |

CUT SHEET MAILER BUSINESS FORM ASSEMBLY

This application is a continuing application of Ser. No. 462,842, filed Dec. 26, 1989, in turn filed as a continuation of application Ser. No. 303,985, filed Jan. 27, 1989, in turn filed as a continuation-in-part application of Ser. No. 97,318, filed Sep. 11, 1987, in turn filed as a continuation of application Ser. No. 900,230, filed Aug. 25, 1986, filed, in turn, as a continuation of application Ser. No. 542,350, filed Oct. 17, 1983.

BACKGROUND AND SUMMARY OF THE INVENTION

This invention relates to business form assemblies, and more particularly, to such assemblies providing mailers.

An object of this invention is to provide an improved cut sheet business form assembly of at least two cut sheets for collation and sealing into at least one mailer per assembly.

Business forms are provided to users either in an essentially finished condition or in an intermediate condition. The finished condition is exemplified by closed and sealed mailers which are ready for mailing after the user has added his information to the exterior of the mailer assembly by impact printer or ink jet printer. Intermediate condition mailers are those in which the interior of the form is exposed to the user. Information may be added to the interior of forms in the intermediate condition by impact printer. Generally, forms shipped in the intermediate condition have a heat sealable adhesive around at least a part of the periphery of the form so that the form may be finally closed and sealed. The final steps of the assembly process employ machines to fold or align the sheets of the form and subsequently apply heat and pressure to activate the heat seal glue around at least part of the periphery of the form.

In recent years, there has been a rapid growth in the use of non-impact printers (NIPs), such as laser printers, because of their versatility and variable printing. Problems have arisen, however, because the non-impact printers which use toner particles generate internal heat to fuse the particles forming the images. The higher temperatures required for fusing the toner soften the hot metal adhesive, causing the flue on the open form to adhere to the internal rolls of the non-impact printers, thus fouling the machine. When such fouling occurs, many times the machine must be partially disassembled and cleaned. This is obviously time consuming and expensive. The present invention avoids this problem of the prior art by providing a business form assembly capable of use in the intermediate condition in conjunction with heat-generating printers.

In a principal aspect, the invention is a cut sheet mailer business form assembly comprising a message sheet and a cover sheet. The message sheet has a longitudinal dimension between end edges along a longitudinal axis and a transverse dimension between marginal edges along a transverse axis. Marginal lines of perforations extend along the marginal edges fully between the end edges. Transverse, end lines of perforations extend along the end edges only between the marginal lines of perforations. No adhesive is present on any portion of the message sheet.

The message cover sheet has a longitudinal dimension between cover sheet end edges equal to the longitudinal dimension of the message sheet, and a transverse dimension between cover sheet marginal edges equal to the transverse dimension of the message sheet. The cover sheet is super-imposed upon the message sheet and has marginal lines of adhesive along the cover sheet marginal edges. These adhesive lines extend fully between the cover sheet end edges and are nearer the cover sheet marginal edges than the message sheet marginal perforation lines are to the message sheet marginal edges. Transverse end lines of adhesive are along the cover sheet end edges, extending fully between the cover sheet marginal edges and being nearer the cover sheet end edges than the message sheet end perforation lines are to the message sheet end edges. Preferably, a cover sheet marginal line of perforations is adjacent to one of the message sheet marginal lines of perforations. The marginal and end lines of adhesive adhere the cover sheet to the message sheet.

Other objects, advantages and features are part of the detailed description of the preferred embodiment. The detailed description follows a brief description of the drawing.

BRIEF DESCRIPTION OF THE DRAWING

The preferred embodiment of the present invention will be described in relation to the accompanying drawing, in which.

DETAILED DESCRIPTION OF THE PREFERRED EMBODIMENT

Figure 1:
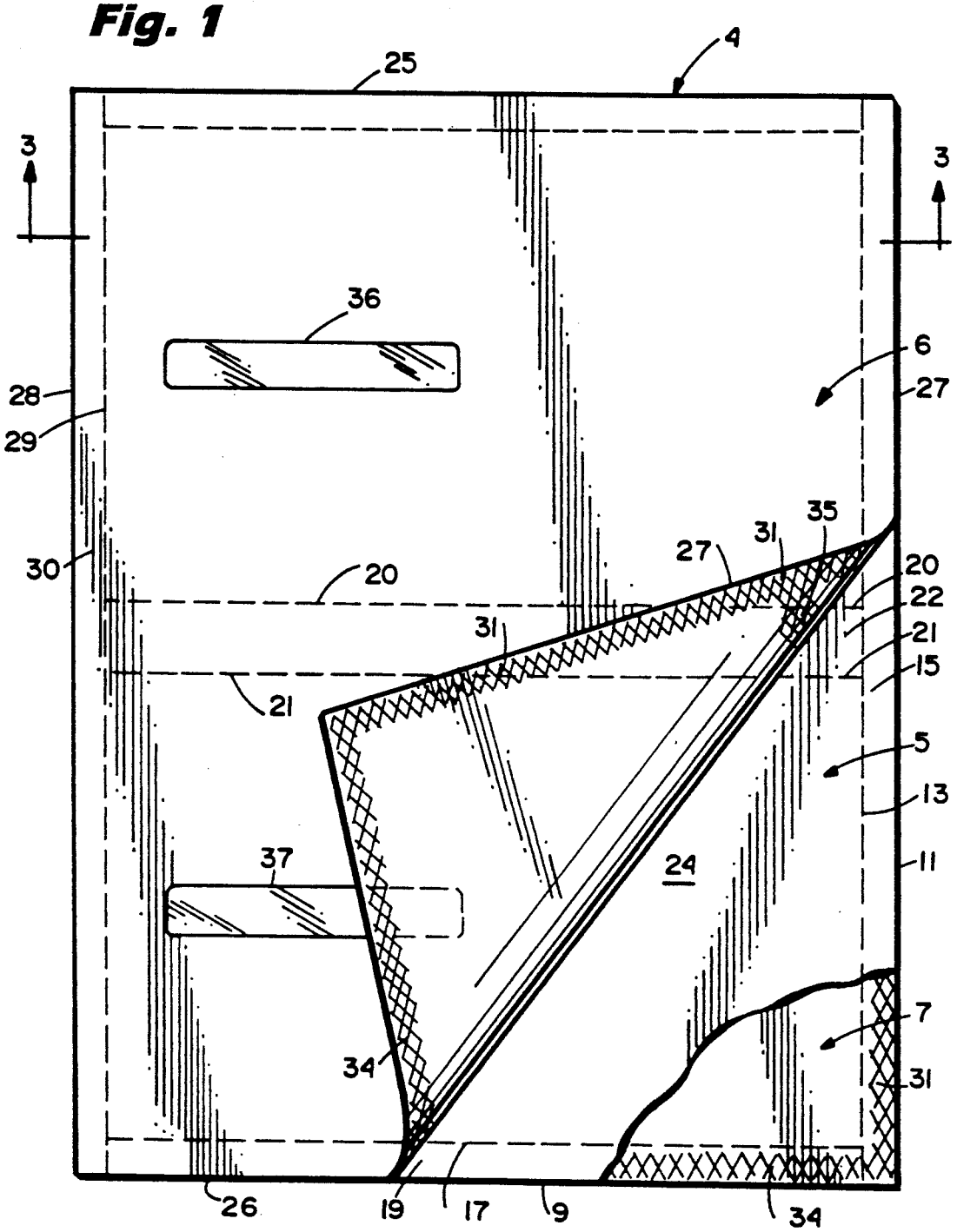
FIG. 1 is a plan view of a preferred cut sheet mailer of the invention, with a corner of a cover sheet turned back pictorially to reveal detail.
Figure 3:
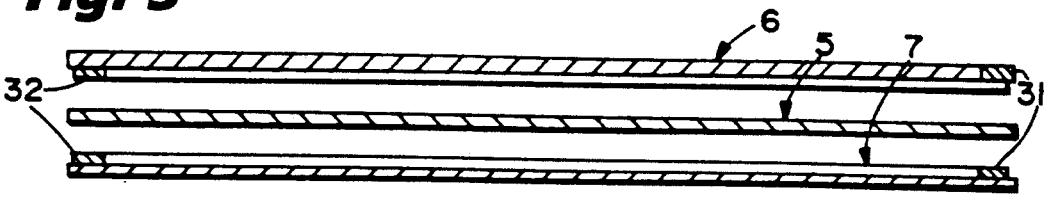
FIG. 3 is a cross-section view taken along line 3—3 of FIG. 1.
Figure 2:
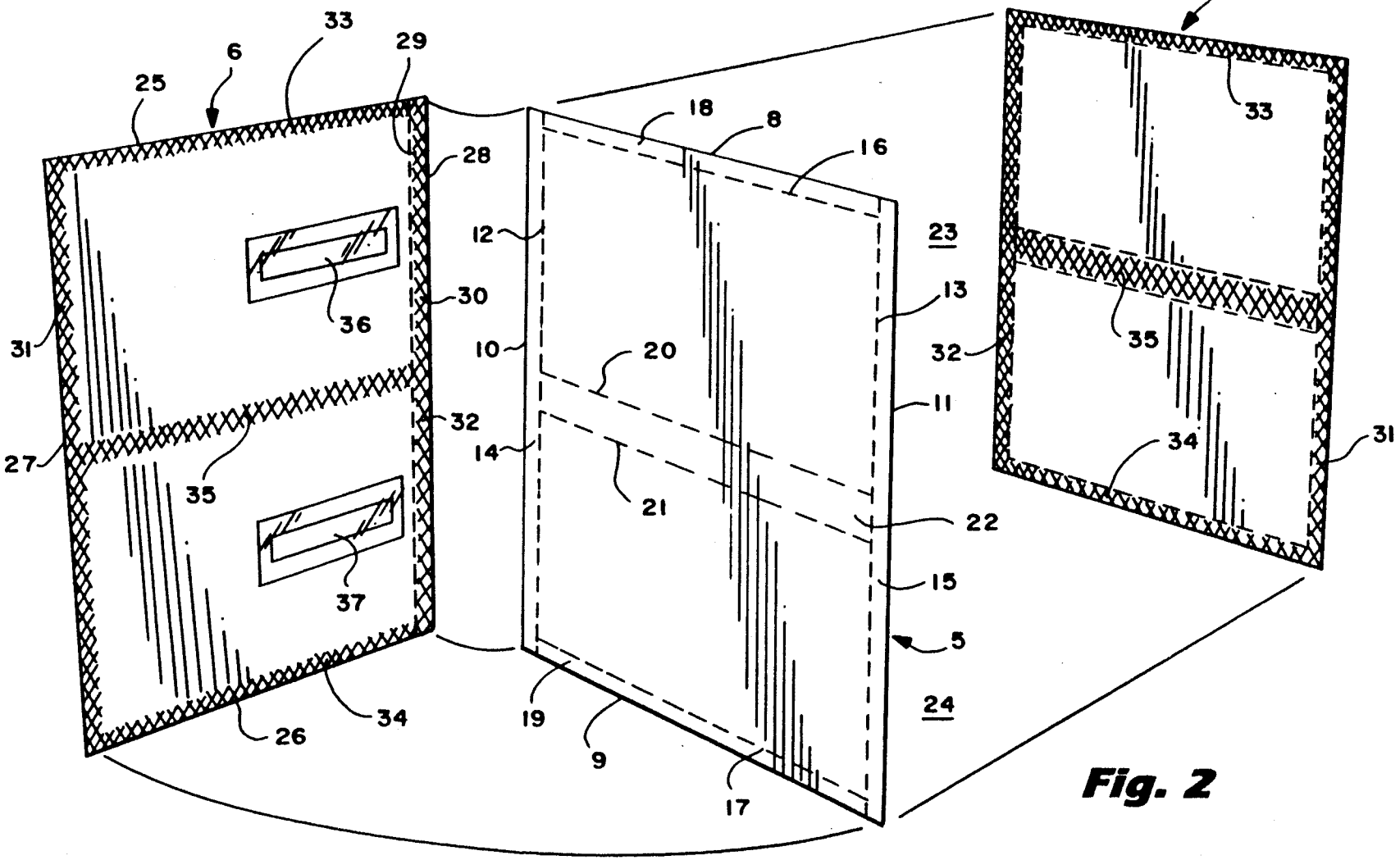
FIG. 2 is an exploded, perspective view of the cut sheet mailer of FIG. 1.

Referring to FIGS. 1–3, the preferred embodiment of the invention is a cut sheet mailer business form assembly 4 comprising a message sheet 5, a top cover sheet 6 and a bottom cover sheet 7. As will be described, when the assembly 4 is completed, the sheets 5, 6, 7 are adhered to each other totally about their peripheries and across their centers. The sheets 5, 6, 7 are shown separated in FIG. 2 as they would be before assembly completion.

The message sheet 5 is rectangular. It has a longitudinal dimension between a straight upper end edge 8 and a straight and parallel lower end edge 9. It has a transverse dimension between straight, parallel, marginal edges 10, 11. The sheet 5 has no pin feed holes, but may be cut from a continuous web.

A first message sheet marginal line of perforations 12 extends along but spaced from the first message sheet marginal edge 10. A second message sheet marginal line of perforations 13 extends along but spaced from the second message sheet marginal edge 11. The lines 12, 13 extend longitudinally, fully between the message sheet end edges 8, 9. The marginal edge 10 and line 12 define a first longitudinally extending margin 14 of the sheet 5. The edge 11 and line 13 define a second longitudinally extending margin 15.

A first, transverse end line of perforations 16 extends along but spaced from the end edge 8. A second, transverse end line of perforations 17 extends along but spaced from the end edge 9. The lines 16, 17 extend only between the marginal perforation lines 12, 13. The edges 8, 9 and lines 16, 17 define end strips 18, 19 on the sheet 5. Preferably, end strips 18, 19 have longitudinal widths approximately equal to each other. No adhesive is present on either side of sheet 5.

At least a pair of adjacent, parallel, non-end lines of perforations 20, 21 extend transversely across the sheet 5, only between the marginal perforation lines 12, 13. The lines 20, 21 and the lines 12, 13 define a central strip 22 on the sheet 5.

The lines 16, 20 and the upper portions of the lines 12, 13 define a first, upper message area 23. The lines 17, 21 and the lower portions of the lines 12, 13 define a second, lower message area 24. The message areas 23, 24 are for two distinct messages, or duplicate messages. As will be described, the central strip 22 is cut to separate the message areas 23, 24.

The top cover sheet 6 has a longitudinal dimension between top cover sheet end edges 25, 26 equal to the longitudinal dimension of the message sheet 5 between its edge ends 8, 9. The top cover sheet 6 also has a transverse dimension between top cover sheet marginal edges 27, 28 equal to the transverse dimension of the message sheet 5 between its marginal edges 10, 11. A single marginal line of perforations 29 extends longitudinally along the top cover sheet marginal edge 28. The line 29 defines a marginal strip 30 on the sheet 6, which has a transverse width less than the width of the message sheet margins 14, 15. Other than for line 29, sheet 6 has no perforations.

Within the marginal strip 30, and within a marginal area along the cover sheet marginal edge 27 having the same transverse width as the strip 30, the sheet 6 has marginal lines of adhesive 31, 32. The adhesive lines 31, 32 extend fully between the top cover sheet end edges 25, 26. The adhesive lines are joined along the end edges 25, 26 by transversely extending, end lines of adhesive 33, 34. The lines 33, 34 are within end areas having longitudinal widths equal to or less than the widths of the message sheet end strips 18, 19. The adhesive lines 31, 32, 33, 34 circumscribe the periphery of the sheet 6. As most preferred, the adhesive lines 31-34 are a heat sealable adhesive. When heated, with the sheet 6 superimposed on the sheet 5, the adhesive adheres sheet 6 to sheet 5, outward of the perforation lines 12, 13, 16, 17 of the sheet 5 and in the margins 14, 15 and end strips 18, 19. The perforation lines 12, 13, 16, 17 remain useful to separate the message areas from the margins 14, 15 and end strips 18, 19. Pressure sensitive or remoistenable adhesive may be employed as an alternate to the heat sealable adhesive.

The marginal adhesive lines 31, 32 are also joined by a wider, transversely extending, non-end line of adhesive 35. The line 35 is located on the sheet 6 to be disposed between the central portion lines 20, 21 of the sheet 5 when the sheets 5, 6 are superimposed as described above. The adhesive line 35 is also preferably heat sealable. When heated, with the sheets 5, 6 superimposed, the adhesive line 35 joins the sheet 6 to the central strip 22 of the sheet 5.

Figure 4:
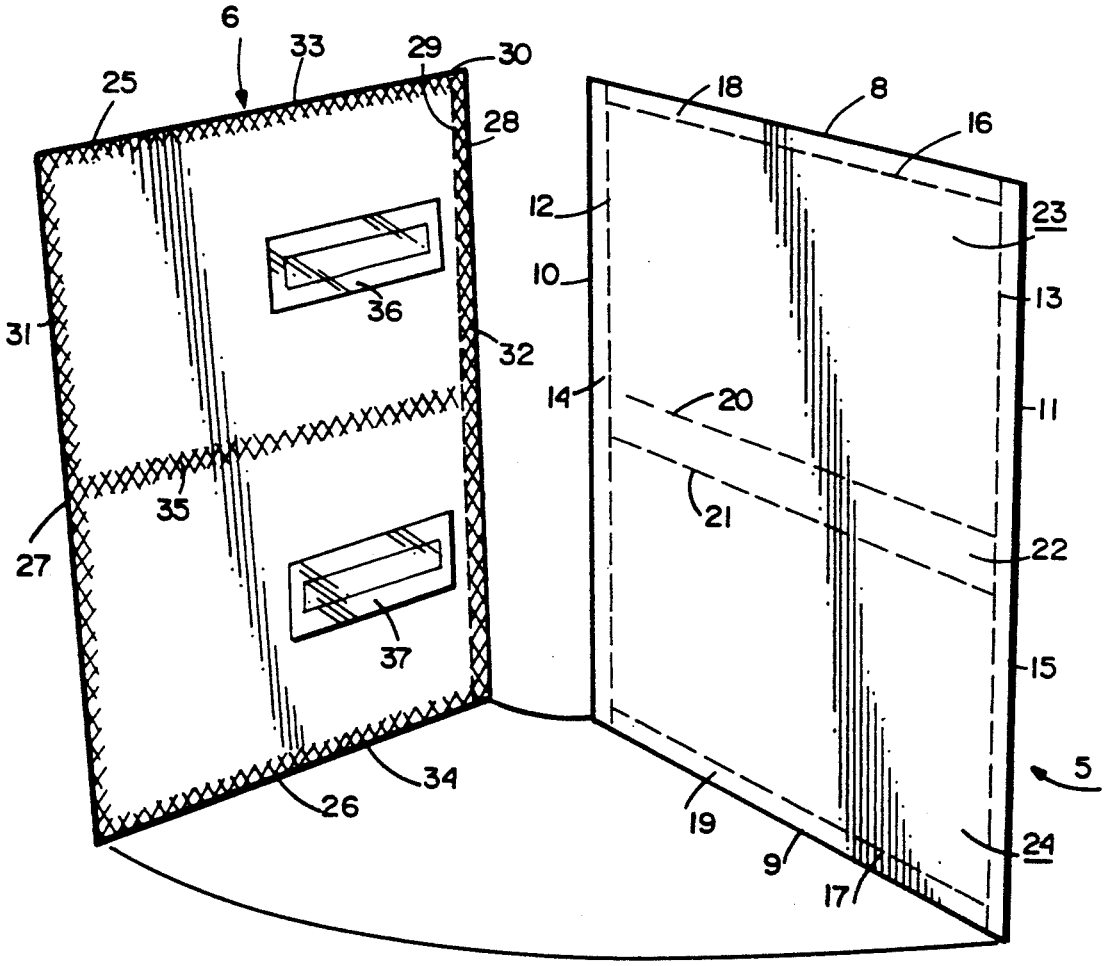
FIG. 4 is an exploded, perspective view of an alternate, preferred cut sheet mailer of the invention.

The sheets 5 and 6, so adhered, form a mailer assembly useful with or without the sheet 7. If used without the sheet 7, as in FIG. 4, the assembly forms two message units which may be separated by a cut transversely across the central strip 22, cutting the adhesive line 35 in two parts. Each separated message unit remains sealed, and may be opened by removal of the top cover sheet marginal strip 30, with the message sheet margin 14, along the perforation lines 29, 12. Since the perforation line 29 is offset from the line 12, an edge is created that can be manually grasped. A message area, such as 23, may then be separated from its message unit, along the perforation lines such as 16, 20, 13. As most preferred, all the transverse perforation lines 16, 20, 21, 17 are progressive, in that perforation size is large toward the edge 10, and is progressively reduced toward edge 11. These progressive perforations facilitate separation of the message areas.

When the assembly has a back cover sheet, the preferred back cover sheet 7 has longitudinal and transverse dimensions equal to those of the cover sheet 6. The sheet 7 also has a pattern of adhesive lines identical to that of sheet 6, and the same reference numbers are used to identify the adhesive lines on sheet 7 as are used on sheet 6. The sheet 7 may be a combined second message and bottom cover sheet.

Figure 5:
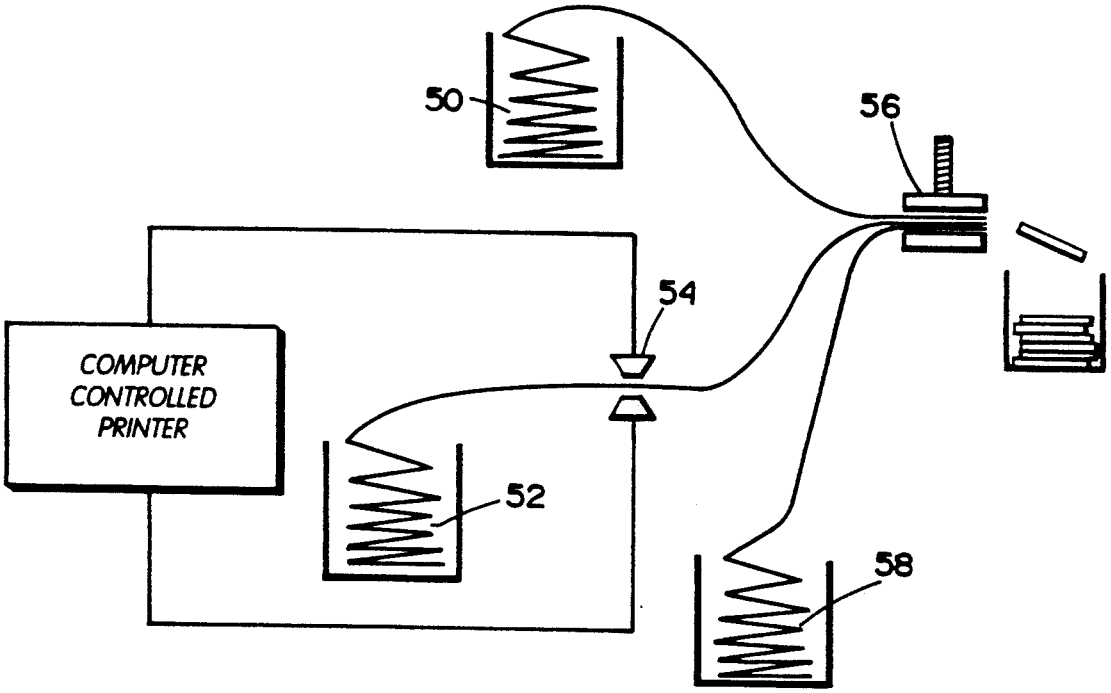
FIG. 5 is a schematic diagram illustrating use of the business form assembly of the present invention in the intermediate condition, depicting printing of the message sheet of the business form assembly with a computer controlled Non-Impact Printer (NIP) as well as collation, sealing and separation of the business form assemblies for mailing.

Referring now to FIG. 5, the use of the assembly in the intermediate condition is disclosed. In the intermediate condition, the cover sheet web 50 and the message sheet web 52 are provided separately. If a back cover sheet is sued, the back cover sheet web 568 is also provided separately. The mailer assembly process is arranged such that the message sheet web 52 passes through printer 54, where the message is added. The adhesive-bearing cover sheet web 50, and back cover sheet web 58, if included, do not pass through the printer but are superimposed on the printed message sheet and fed into a collating and sealing machine 56, where the webs are joined, sealed and detached as finished forms ready to be mailed.

The preferred embodiments of the invention is now described. [The assembly may be fed into a collating and sealing machine with messages preprinted on the message areas. The sheets may be automatically collated, sealed together and the message units severed.] If preferred, the message units may be self-contained envelopes with transparent-covered windows, such as windows 36, 37, shown on sheet 6.

The preferred embodiment may be varied, without departing from the invention. As an example, the adhesive line 35 and paired perforation lines 20, 21 may be repeated, to form three or more message units per assembly. Therefore, to particularly point out and distinctly claim the subject matter regarded as invention, the following claims conclude this specification.

What is claimed is:

1. An improved intermediate condition cut sheet mailer business form package comprising:

a rectangular message sheet having end edges, marginal edges, a longitudinal dimension between the end edges along a longitudinal axis, and a transverse dimension between the marginal edges along a transverse axis, said message sheet being provided as a continuous web without pin feed holes along said marginal edges, marginal lines of perforations along the marginal edges of the message sheet extending fully between the end edges, transverse end lines of perforations extending along the end edges between the marginal lines of perforations;

a rectangular cover sheet having cover sheet end edges, cover sheet marginal edges, a longitudinal dimension between the cover sheet end edges equal to the longitudinal dimension of the message sheet, a transverse dimension between the cover sheet marginal edges equal to the transverse dimension of the message sheet, said cover sheet being provided as a continuous web without pin feed holes along said marginal edges thereof;

the cover sheet adapted to be superimposed upon the message sheet and further having marginal lines of pressure sensitive adhesive along the cover sheet marginal edges extending fully between the cover sheet end edges and being nearer the cover sheet marginal edges than the message sheet marginal perforation lines are to the message sheet marginal edges, transverse end lines of adhesive along the cover sheet end edges extending fully between the cover sheet marginal edges and being nearer the cover sheet end edges than the message sheet end perforation lines are to the message sheet end edges, the marginal and end lines of adhesive adapted to adhere the cover sheet to the message sheet;

wherein the message sheet is provided free of adhesive.

2. An improved intermediate condition cut sheet mailer business form package as in claim 1 in which the cover sheet has one marginal line of perforations only along one cover sheet marginal edge only adjacent to one of the message sheet marginal lines of perforations.

3. An improved intermediate condition cut sheet mailer business form package as in claim 1 in which the message sheet further has at least a pair of adjacent, non-end, multiple-message-area-defining transverse lines of perforations extending between the message sheet marginal perforation lines; and in which the cover sheet further has at least a non-end, multiple-mailer-adhering transverse line of adhesive between the non-end transverse lines of perforations and extending fully between the marginal lines of adhesive.

4. An improved intermediate condition cut sheet mailer business form package comprising:

a rectangular message sheet having end edges, marginal edges, a longitudinal dimension between the end edges along a longitudinal axis, and a transverse dimension between the marginal edges along the transverse axis, said message sheet being provided as a continuous web without pin feed holes along said marginal edges, marginal lines of perforations along the marginal edges of the message sheet extending fully between the end edges, transverse end lines of perforations extending along the end edges between the marginal lines of perforations;

said message sheet being adapted for printing thereon by a nonimpact (NIP) printer; and a rectangular cover sheet having cover sheet end edges, cover sheet marginal edges, a longitudinal dimension between the cover sheet end edges equal to the longitudinal dimension of the message sheet, a transverse dimension between the cover sheet marginal edges equal to the transverse dimension of the message sheet, said cover sheet being provided as a continuous web without pin feed holes along said marginal edges thereof;

the cover sheet adapted to be superimposed upon the message sheet and further having marginal lines of pressure sensitive adhesive along the cover sheet marginal edges extending fully between the cover sheet end edges and being nearer the cover sheet marginal edges than the message sheet marginal perforation lines are to the message sheet marginal edges, transverse end lines of adhesive along the cover sheet end edges extending fully between the cover sheet marginal edges and being nearer the cover sheet end edges than the message sheet end perforation lines are to the message sheet end edges, the marginal and end lines of adhesive adapted to adhere the cover sheet to the message sheet;

wherein the message sheet is provided free of adhesive.

5. An improved intermediate condition cut sheet mailer business form package comprising:

a rectangular message sheet having end edges, marginal edges, a longitudinal dimension between the end edges along a longitudinal axis, and a transverse dimension between the marginal edges along a transverse axis, marginal lines of perforations along the marginal edges of the message sheet extending fully between the end edges, transverse end lines of perforations extending along the end edges between the marginal lines of perforations;

a rectangular cover sheet having cover sheet end edges, cover sheet marginal edges, a longitudinal dimension between the cover sheet end edges equal to the longitudinal dimension of the message sheet, a transverse dimension between the cover sheet marginal edges equal to the transverse dimension of the message sheet;

said cover sheet comprising a top cover sheet adapted to be superimposed upon the message sheet and further having marginal lines of adhesive along the cover sheet marginal edges extending fully between the cover sheet end edges and being nearer the cover sheet marginal edges than the message sheet marginal perforation lines are to the message sheet marginal edges, transverse end lines of adhesive along the cover sheet end edges extending fully between the cover sheet marginal edges and being nearer the cover sheet end edges than the message sheet end perforation lines are to the message sheet end edges, the marginal and end lines of adhesive adapted to adhere the cover sheet to the message sheet;

said message sheet being free of adhesive; and a rectangular bottom sheet having bottom sheet end edges, bottom sheet marginal edges, a longitudinal dimension between the bottom sheet end edges equal to the longitudinal dimension of the message sheet, a transverse dimension between the bottom sheet marginal edges equal to the transverse dimension of the message sheet, marginal lines of perforations along the bottom sheet marginal edges extending fully between the bottom sheet end edges, transverse end lines of perforations extending along the bottom sheet end edges between the bottom sheet marginal lines of perforations;

the message sheet adapted to be superimposed upon the bottom sheet and the bottom sheet further having marginal lines of adhesive along the bottom sheet marginal edges extending fully between sheet end edges and being nearer the bottom sheet marginal edges than the message sheet marginal perforation lines are to the message sheet marginal edges, transverse end lines of adhesive along the bottom sheet end edges extending fully between the bottom sheet marginal edges and being nearer the bottom sheet end edges than the message sheet end perforation lines are to the message sheet end edges, the bottom sheet marginal and end lines of adhesive adapted to adhere the bottom sheet to the message sheet.

6. The improved intermediate condition cut sheet mailer business form package of claim 5 wherein the message sheet is provided as a continuous web.

7. An improved intermediate condition cut sheet mailer business form package comprising:

a rectangular message sheet having end edges, marginal edges, a longitudinal dimension between the end edges along a longitudinal axis and a transverse dimension between the marginal edges along a transverse axis, marginal lines of perforations along the marginal edges of the message sheet extending fully between the end edges, transverse end lines of perforations extending along the end edges between the marginal lines of perforations;

a rectangular cover sheet having cover sheet end edges, cover sheet marginal edges, a longitudinal dimension between the cover sheet end edges equal to the longitudinal dimension of the message sheet, a transverse dimension between the cover sheet marginal edges equal to the transverse dimension of the message sheet;

said cover sheet comprising a top cover sheet adapted to be superimposed upon the message sheet and further having marginal lines of adhesive along the cover sheet marginal edges extending fully between the cover sheet end edges and being nearer the cover sheet marginal edges than the message sheet marginal perforation lines are to the message sheet marginal edges, transverse end lines of adhesive along the cover sheet end edges extending fully between the cover sheet marginal edges and being nearer the cover sheet end edges than the message sheet end perforation lines are to the message sheet end edges, the marginal and end lines of adhesive adapted to adhere the cover sheet to the message sheet;

said message sheet being free of adhesive; and a rectangular bottom sheet having bottom sheet end edges, bottom sheet marginal edges, a longitudinal dimension between the bottom sheet end edges equal to the longitudinal dimension of the message sheet, a transverse dimension between the bottom sheet marginal edges equal to the transverse dimension of the message sheet, marginal lines of perforations along the bottom sheet marginal edges extending fully between the bottom sheet end edges, transverse end lines of perforations extending along the bottom sheet end edges between the bottom sheet marginal lines of perforations;

the message sheet adapted to be superimposed upon the bottom sheet and further adapted to being printed thereon by a nonimpact (NIP) printer; and the bottom sheet further having marginal lines of adhesive along the bottom sheet marginal edges extending fully between the bottom sheet end edges and being nearer the bottom sheet marginal edges than the message sheet marginal perforation lines are to the message sheet marginal edges, transverse end lines of adhesive along the bottom sheet end edges extending fully between the bottom sheet marginal edges and being nearer the bottom sheet end edges than the message sheet end perforation lines are to the message sheet end edges, the bottom sheet marginal and end lines of adhesive adapted to adhere the bottom sheet to the message sheet.

8. The improved intermediate condition cut sheet mailer business form package of claim 7 wherein the message sheet is provided as a continuous web.

* * * * *